US010290481B2

(12) United States Patent
Kubo

(10) Patent No.: US 10,290,481 B2
(45) Date of Patent: May 14, 2019

(54) MASS SPECTROMETRY DATA ANALYSIS METHOD

(71) Applicant: JEOL Ltd., Tokyo (JP)

(72) Inventor: Ayumi Kubo, Tokyo (JP)

(73) Assignee: JEOL Ltd., Tokyo (JP)

( * ) Notice: Subject to any disclaimer, the term of this patent is extended or adjusted under 35 U.S.C. 154(b) by 0 days.

(21) Appl. No.: 15/645,092

(22) Filed: Jul. 10, 2017

(65) Prior Publication Data

US 2018/0019110 A1 Jan. 18, 2018

(30) Foreign Application Priority Data

Jul. 12, 2016 (JP) ..... 2016-137860

(51) Int. Cl.
*H01J 49/00* (2006.01)

(52) U.S. Cl.
CPC ..... *H01J 49/0036* (2013.01)

(58) Field of Classification Search
CPC ..... H01J 47/0036
See application file for complete search history.

(56) References Cited

PUBLICATIONS

Reinhardt et al., "Ultrahigh Mass Resolution and Accurate Mass Measurements as a Tool to Characterize Oligomers in Secondary Organic Aerosols", Anal. Chem., Jun. 1, 2007, pp. 4074-4082, vol. 79, No. 11.

*Primary Examiner* — Eliza W Osenbaugh-Stewart
(74) *Attorney, Agent, or Firm* — The Webb Law Firm

(57) ABSTRACT

A mass spectrometry data analysis method for analyzing a specimen having a composition where two different reference chemical structures A and B that are each repeated, includes acquiring exact mass information of each peak in a mass spectrum of the specimen by mass spectrometry, acquiring Kendrick mass defect information $D_A$ and $D_B$ where a decimal number part has been extracted from mass information obtained by performing Kendrick mass conversion computation processing on exact mass information of each peak, acquiring mass defect information $d_B$ and $d_A$ where a decimal number part has been extracted from mass information of B based on A and A based on B of the reference chemical structures A and B, calculating $$n_A=D_B/d_A, n_B=D_A/d_B$$

regarding $D_A$, $D_B$, $d_A$, and $d_B$, and obtaining degree-of-polymerization information $n_A$ and $n_B$, and displaying plots corresponding to each peak on two-dimensional coordinates where $n_A$ and $n_B$ are axes.

1 Claim, 9 Drawing Sheets

FIG. 3A
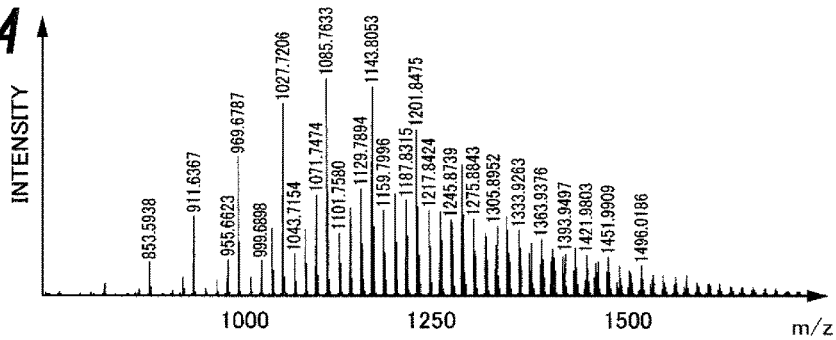
FIG. 3B
| PEAK NO. | EXACT MASS INFORMATION | INTENSITY |
|---|---|---|
| 1 | ··· | ··· |
| 2 | 969.6787 | 8102 |
| 3 | ··· | ··· |
| 4 | 1085.7633 | 13042 |
| 5 | 1101.7580 | 3942 |
| 6 | ··· | ··· |
| 7 | 1143.8053 | 11984 |
| 8 | ··· | ··· |
FIG. 3C
| PEAK NO. | EXACT MASS INFORMATION | INTENSITY | $D_A$ | $D_B$ | $d_A$ | $d_B$ | $n_A$ | $n_B$ |
|---|---|---|---|---|---|---|---|---|
| 1 | ··· | ··· | ··· | ··· | −0.00513255 | 0.006766424 | ··· | ··· |
| 2 | 969.6787 | 8102 | 0.101423 | −0.011621 | −0.00513255 | 0.006766424 | 2.264177 | 14.98916 |
| 3 | ··· | ··· | ··· | ··· | −0.00513255 | 0.006766424 | ··· | ··· |
| 4 | 1085.7633 | 13042 | 0.116914 | −0.009662 | −0.00513255 | 0.006766424 | 1.882495 | 17.27855 |
| 5 | 1101.7580 | 3942 | 0.120926 | −0.026349 | −0.00513255 | 0.006766424 | 5.133705 | 17.87148 |
| 6 | ··· | ··· | ··· | ··· | −0.00513255 | 0.006766424 | ··· | ··· |
| 7 | 1143.8053 | 11984 | 0.1243606 | −0.008983 | −0.00513255 | 0.006766424 | 1.750202 | 18.37907 |
| 8 | ··· | ··· | ··· | ··· | −0.00513255 | 0.006766424 | ··· | ··· |
FIG. 3D
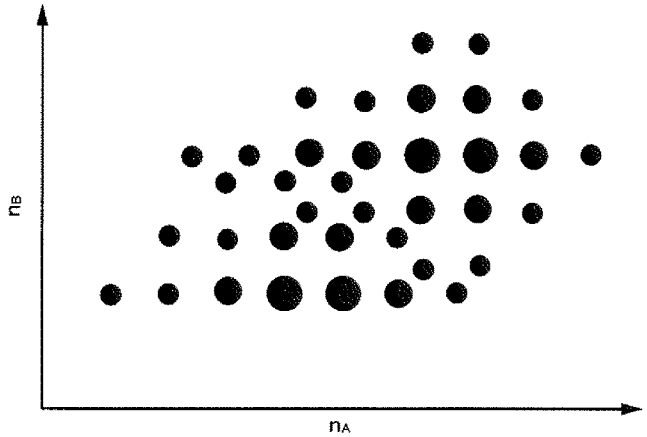

MASS SPECTROMETRY DATA ANALYSIS METHOD

BACKGROUND OF THE INVENTION

1. Field of the Invention

The present invention relates to a mass spectrometry data analysis method.

2. Description of the Related Art

In mass spectrometry, a polymer that has only one type of repeat unit exhibits only one type of peak interval in a mass spectrum where the horizontal axis is mass-to-charge ratio m/z and the vertical axis is ionic intensity, as illustrated in FIG. 6A. Accordingly, the dispersion state of the degree of polymerization illustrated in FIG. 6B can be read relatively easily from the mass spectrum in FIG. 6A.

Kendrick mass plot is one technique to visualize distribution information of a specimen having a repeat unit (e.g., see Anal. Chem., 2007, 79, p 4074-4082).

In a Kendrick mass plot, a Kendrick mass defect (KMD) is found for each peak appearing in a mass spectrum, and each peak is plotted on coordinates where the horizontal axis is mass, and the vertical axis is the KMD. The KMD refers to the remainder obtained by subtracting the nominal part from the Kendrick mass that is mass recalculated using a reference different from the International Union of Pure and Applied Chemistry (IUPAC) definition where C=12 (generally $CH_2$=14).

That is to say, the analysis method based on the KMD was proposed by Kendrick et al. for elemental composition analysis of saturated hydrocarbon having a repeat unit of methylene ($CH_2$) units. The exact mass of the repeating unit $CH_2$ on the IUPAC mass scale (theoretical value: 14.01565) is defined as Kendrick mass (KM)=14, and the observed exact mass (observed IUPAC mass) of each peak appearing in the mass spectrum is converted into KM using the following Expression.

$$KM = \text{observed IUPAC mass} \times 14.00000/14.01565$$

The repeating unit structure is not restricted to $CH_2$, and in the case where the specimen is a polymer for example, monomers can be the unit structure. Accordingly, the above expression commonly is written as "KM=observed IUPAC mass of each peak×nominal mass of unit structure/IUPAC mass of unit structure . . . (1)".

The integer closest to the KM obtained by calculation (the nearest integer of KM) is the nominal KM (NKM), with the KMD being defined as the difference between NKM and KM, i.e., KMD=NKM−KM.

A Kendrick mass plot commonly involves plotting points representing peaks on two-dimensional coordinates where the horizontal axis is the observed mass (m/z), KM, or NKM, and the vertical axis is KMD, with the point being imparted with sizes, color types, darkness, and so forth, in accordance with the intensity information of each peak.

For example, the Kendrick mass plot illustrated in FIG. 7B can be obtained by applying a suitable repeating unit structure (e.g., $CH_2$) to the mass spectrum illustrated in FIG. 7A, obtaining the KMD of each peak by giving the nominal mass and exact mass of the unit structure, and plotting each peak on two-dimensional coordinates where the horizontal axis is the observed mass (m/z) and the vertical axis is KMD, based on the obtained KMD. The Kendrick mass plot illustrated in FIG. 7B indicates the intensity information of each peak by the size of the plotted points.

For example, in a case where there are structures such as expressed by (A)nX in a specimen, where the terminal group (X) is the same and the number of repeats (n) of the repeating unit structure (A) differ, giving the exact mass of the unit structure A for each peak in the obtained mass spectrum to obtain the KMD results in these peaks being plotted on a horizontal straight line on the Kendrick mass plot, since all peaks expressed by (A)nX have the same KMD.

Also, in a case where there are peaks in the same spectrum having the same (A)n repeat unit but a different terminal group (X'), these peaks equally have a different KMD that differs from the case where the terminal group is X, so these peaks are plotted on a horizontal straight line on the Kendrick mass plot, at a different vertical position from the case where the terminal group is X.

On the other hand, in a case where peaks of a different repeat unit (B)n are present in the same mass spectrum, these peaks will be plotted along a straight line on the Kendrick mass plot that is not horizontal but has an inclination.

In the Kendrick mass plot illustrated in FIG. 7B, there were no peaks having the repeating unit structure given to obtain the KMD, so there are no points plotted along a straight horizontal line. Peak groups are divided into and plotted along two straight lines inclined as to the horizontal axis. Looking at the correlation as to the peaks in the mass spectrum in FIG. 7A, the peak group on the upper straight line in FIG. 7B corresponds to the peak group with short repeat intervals in the mass spectrum, and the peak group on the lower straight line corresponds to the peak group with long repeat intervals in the mass spectrum. Accordingly, it can be seen from the Kendrick mass plot in FIG. 7B that there are two types of substances with different repeat units included.

In a case where multiple terminal structures exist, or in a copolymer having two or more types of repeat units, the mass spectrum becomes complicated, and it is difficult to obtain information of the distribution of the degree of polymerization.

In a case where multiple end groups exist, sub-peaks of the terminal structures are observed in a shifted manner, although at the same peak interval, as in the mass spectrum illustrated in FIG. 8 for example, so it is difficult to read the distribution of the degree of polymerization of the repeat units from the mass spectrum.

Also, with copolymers having two or more types of repeat units, peaks having two types or more of intervals are observed as in the mass spectrum illustrated in FIG. 9 for example, although this also depends on the dispersion of degree of polymerization of each component, so a very great number of peaks are observed. Accordingly, it is difficult to read the distribution of degree of polymerization of each repeat unit (repeating A and repeating B at the right in FIG. 9).

Conversely, in a case of employing the analysis method using the Kendrick mass plot, even with a copolymer, ions that have the same the degree of polymerization of one repeat unit out of two repeat units, and a different degree of polymerization of the other repeat unit, are laid out on a straight line, so information of the degree of polymerization of each component is easier to comprehend as compared to a mass spectrum.

That is to say, in a case of a copolymer, even if the mass spectrum is complex such as illustrated in FIG. 10A, employing the analysis method using the Kendrick mass plot plots ions having the same degree of polymerization for each repeat unit on straight lines, as illustrated in FIG. 10B. Accordingly, information of the degree of polymerization of each component can be easily read.

However, in a case where the compositions of two repeat units are similar even if one repeat unit is used as a reference, the deviation of Kendrick mass defect as to the m/z of the two repeat units is in close proximity. Accordingly, the points are close to each other as illustrated in FIG. 11 for example, making it difficult to comprehend the results.

SUMMARY OF THE INVENTION

Accordingly, it is an object of the present invention to provide a mass spectrometry data analysis method that enables analysis of specimens having two repeat units with similar compositions.

A mass spectrometry data analysis method according to the present invention is a mass spectrometry data analysis method for analyzing a specimen having a composition where two different reference chemical structures A and B that are each repeated. The method includes:

(1) a mass spectrometry process of acquiring mass spectrum data by performing mass spectrometry of the specimen using a mass spectroscope capable of acquiring exact mass information, and acquiring exact mass information of each peak appearing on the mass spectrum;

(2) a first Kendrick mass conversion process of performing Kendrick mass conversion computation processing on exact mass information of each peak obtained in the mass spectrometry process, based on exact mass theoretical value information and nominal mass information for each of the reference chemical structures A and B, to obtain Kendrick mass information for each peak, and extracting a decimal number part of each Kendrick mass information to obtain each of Kendrick mass defect information $D_A$ and $D_B$ for each peak;

(3) a second Kendrick mass conversion process of performing Kendrick mass conversion computation processing on exact mass theoretical value information of the reference chemical structure B based on exact mass theoretical value information and nominal mass information of the reference chemical structure A to acquire Kendrick mass information, and extracting a decimal number portion of the obtained Kendrick mass information to acquire Kendrick mass defect information $d_A$, and performing Kendrick mass conversion computation processing on exact mass theoretical value information of the reference chemical structure A based on exact mass theoretical value information and nominal mass information of the reference chemical structure B to acquire Kendrick mass information, and extracting a decimal number portion of the obtained Kendrick mass information to acquire Kendrick mass defect information $d_B$;

(4) a degree-of-polymerization information acquisition process of performing computation of $$n_A=D_B/d_A, n_B=D_A/d_B$$

on the Kendrick mass defect information $D_A$ and $D_B$ of each peak obtained in the first Kendrick mass conversion process, using the Kendrick mass defect information $d_A$ and $d_B$ obtained in the second Kendrick mass conversion process, thereby obtaining degree-of-polymerization information $n_A$ and $n_B$ for each peak; and (5) a display process of displaying plots corresponding to each peak on two-dimensional coordinates where the $n_A$ is a first axis and the $n_B$ is a second axis, based on the degree-of-polymerization information $n_A$ and $n_B$ for each peak obtained in the degree-of-polymerization information acquisition process.

Another mass spectrometry data analysis method according to the present invention is a mass spectrometry data analysis method for analyzing a specimen having a composition where two different reference chemical structures A and B that are each repeated, the method comprising:

(1) a mass spectrometry process of acquiring mass spectrum data by performing mass spectrometry of the specimen using a mass spectroscope capable of acquiring exact mass information, and acquiring exact mass information of each peak appearing on the mass spectrum;

(2) a first Kendrick mass conversion process of performing Kendrick mass conversion computation processing on exact mass information of each peak obtained in the mass spectrometry process, based on exact mass theoretical value information and nominal mass information for each of the reference chemical structures A and B, to obtain Kendrick mass information for each peak, and extracting a decimal number part of each Kendrick mass information to obtain each of Kendrick mass defect information $D_A$ and $D_B$ for each peak;

(3) a second Kendrick mass conversion process of performing Kendrick mass conversion computation processing on exact mass theoretical value information of the reference chemical structure B based on exact mass theoretical value information and nominal mass information of the reference chemical structure A to acquire Kendrick mass information, and extracting a decimal number portion of the obtained Kendrick mass information to acquire Kendrick mass defect information $d_A$, and performing Kendrick mass conversion computation processing on exact mass theoretical value information of the reference chemical structure A based on exact mass theoretical value information and nominal mass information of the reference chemical structure B to acquire Kendrick mass information, and extracting a decimal number portion of the obtained Kendrick mass information to acquire Kendrick mass defect information $d_B$;

(4) a degree-of-polymerization information acquisition process of performing computation of $$n_A=D_B/d_A, n_B=D_A/d_B$$

on the Kendrick mass defect information $D_A$ and $D_B$ of each peak obtained in the first Kendrick mass conversion process, using the Kendrick mass defect information $d_A$ and $d_B$ obtained in the second Kendrick mass conversion process, thereby obtaining degree-of-polymerization information $n_A$ and $n_B$ for each peak;

(5) a process of extracting decimal number parts $dn_A$ and $dn_B$ from degree-of-polymerization information $n_A$ and $n_B$ for each peak; and (6) a display process of displaying plots corresponding to each peak on two-dimensional coordinates where, the $dn_A$ is a first axis and the $dn_B$ is a second axis, based on the decimal number parts $dn_A$ and $dn_B$ extracted for each peak.

According to the mass spectrometry data analysis method of the present invention as described above, the degree of polymerization of each repeat unit can be plotted equidistantly, so the distribution of the degree of polymerization can be clearly comprehended, regardless of whether or not the repeat units are similar. Accordingly, complex polymer analysis can be easily performed.

Also, according to the present invention, specimens which heretofore could not be analyzed can now be analyzed, so the scope of specimens that can be analyzed can be broadened as compared to conventional mass spectroscopes and mass spectrometry methods.

BRIEF DESCRIPTION OF THE DRAWINGS

FIGS. 3A through 3D are diagrams for describing the flow of procedures from step S10 through step S16 in FIG. 2.

FIG. 11 is a diagram illustrating the distribution of Kendrick mass defect in a case where the compositions of two repeat units of a copolymer are similar.

DESCRIPTION OF THE PREFERRED EMBODIMENTS

A preferred embodiment of the present invention will be described in detail below with reference to the drawings. It should be noted that the embodiment described below does not unreasonably restrict the contents of the present invention laid forth in the Claims. Further, not all configurations described below are necessarily essential components of the present invention.

1. Mass Spectroscope

Figure 1:
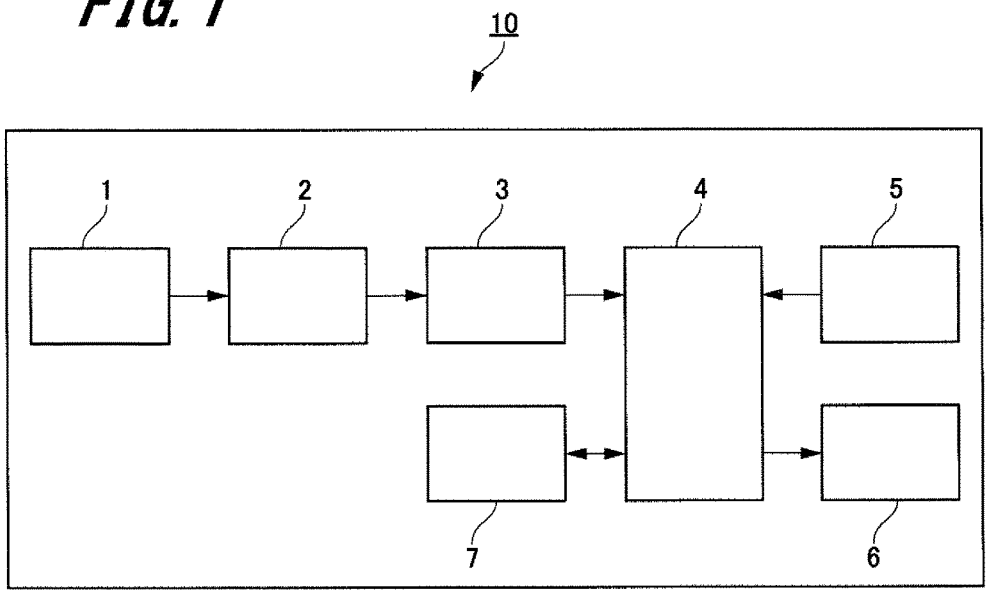
FIG. 1 is a schematic configuration diagram (block diagram) of an embodiment of a mass spectroscope for carrying out a mass spectrometry data analysis method according to the present invention.

FIG. 1 is a schematic configuration diagram (block diagram) of a mass spectroscope for carrying out the mass spectrometry data analysis method according to the present invention.

The mass spectroscope 10 illustrated in FIG. 1 includes an ion source 1, a mass spectrometry unit 2, a detection unit 3, a processing unit 4, an operating unit 5, a display unit 6, and a storage unit 7.

The ion source 1 ionizes a specimen according to a predetermined method, and the generated specimen ions are introduced to the mass spectrometry unit 2.

The mass spectrometry unit 2 separates the ions generated at the ion source 1. For example, in a case where the mass spectrometry unit 2 is a time-of-flight mass spectrometry unit, the ions are separated based on difference in time of flight, in accordance with the mass-to-charge ratio m/z.

The detection unit 3 detects ions separated at the mass spectrometry unit 2. Specifically, the detection unit 3 outputs analog signals in accordance with the amount (intensity) of incident ions to the detection unit 3. The output analog signals are transmitted to the processing unit 4.

Detection signals obtained at the detection unit 3 are transmitted to the processing unit 4, converted into digital signals, and stored in the storage unit 7 as mass spectrometry data. The processing unit 4 is made up of hardware including a processor and so forth, device control programs for controlling the ion source 1, mass spectrometry unit 2, and detection unit 3, and data processing programs for processing mass spectrometry data.

The operating unit 5 is for the user to input information. The input information is output to the processing unit 4. The functions of the operating unit 5 can be realized by various types of switches (pushbuttons, etc.), a touch panel, a keyboard, or the like.

The display unit 6 displays various types of information by text and images.

For example, information input at the operating unit 5 (for confirmation of information), results detected at the detection unit 3, conditions of processing at the processing unit 4, results of processing at the processing unit 4, and so forth, can be displayed on the display unit 6.

The functions of the display unit 6 can be realized by various types of displays.

Figure 2:
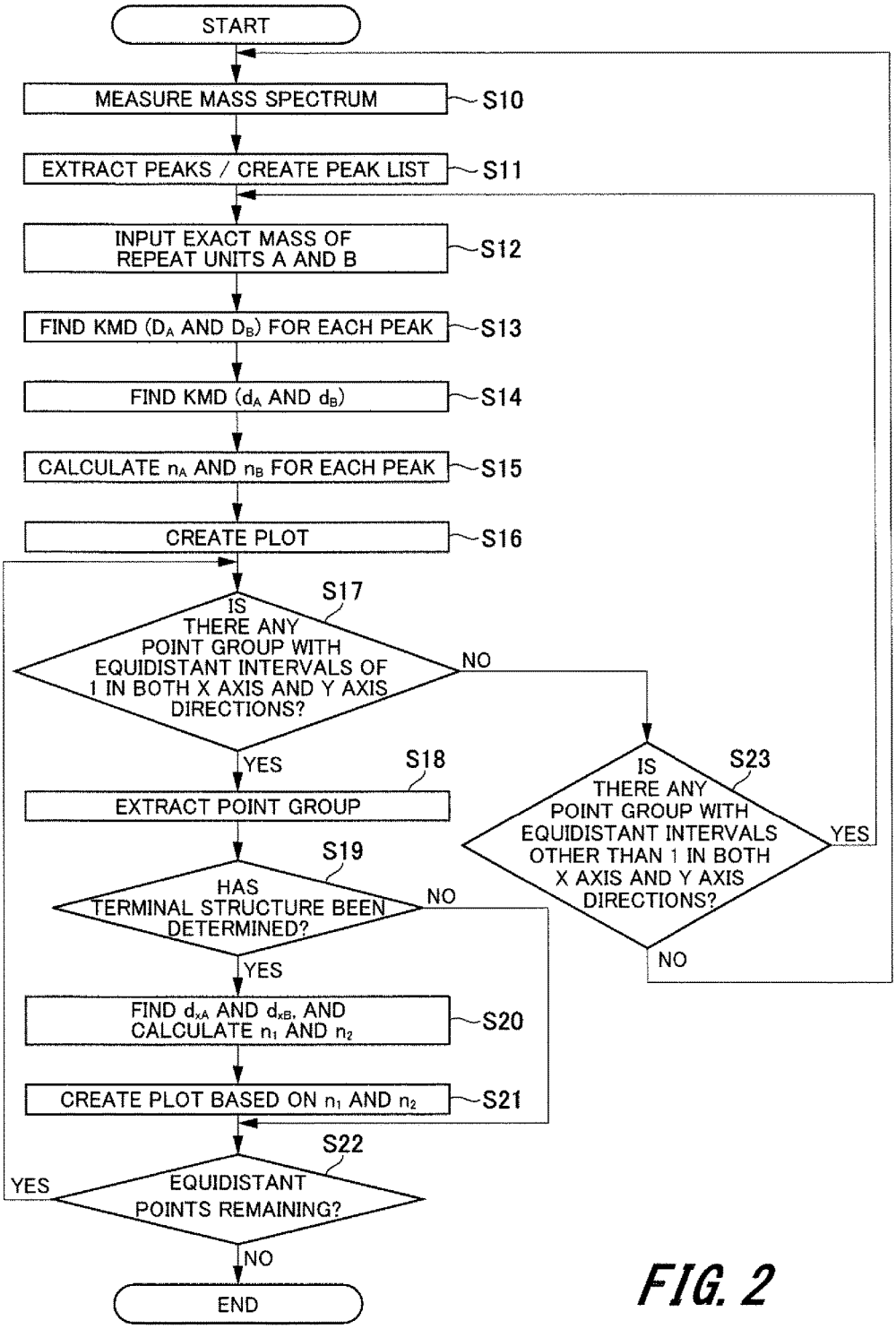
FIG. 2 is a flowchart of one aspect of the mass spectrometry data analysis method carried out by the mass spectroscope illustrated in FIG. 1.

Next, the mass spectrometry data analysis method performed using the mass spectroscope 10 having the above-described configuration will be described with reference to the flowchart in FIG. 2.

First, in step S10, a specimen having two repeat units A and B is introduced to the ion source 1, and mass spectrum measurement is performed.

That is to say, the specimen is ionized at the ion source 1, the ions are separated at the mass spectrometry unit 2 in accordance to the mass-to-charge ratio, the separated ions are detected at the detection unit 3, obtained detection signals are converted into digital signals by the processing unit 4 and read in, thereby acquiring mass spectrum data.

Next, in step S11, the processing unit 4 performs peak extraction processing using an appropriate threshold value for separating the obtained mass spectrum data from noise, and creates a list of the extracted peaks. This list of peaks is a listing of values of observed mass-to-charge ratio m/z and intensity for each peak, numbered from the low-mass side, as illustrated in FIG. 3B. FIG. 3A illustrates an example of a mass spectrum displayed on the display unit 6 based on this peak list.

Note that deisotoping, where isotope peaks are reduced to one peak, is preferably performed in step S11, thereby reducing the number of peaks.

Next, in step S12, the operator uses the operating unit 5 to input mass information relating to the two repeat units A and B (exact mass information and nominal mass information for A and B) to the processing unit 4, based on composition information of the specimen known beforehand. Now, in a case where it is known that the repeat unit A is $C_2H_4O$, and that the repeat unit B is $C_3H_6O$, the operator inputs the exact mass 44.02621 and the nominal mass 44 of $C_2H_4O$ as the exact mass information for the repeat unit A, and inputs the exact mass 58.04132 and nominal mass 58 of $C_3H_6O$ as the exact mass information for the repeat unit B.

In a case where the repeat unit is not known, the operator may estimate or identify the two repeat units from the displayed mass spectrum as in FIG. 3A, and input the exact mass information of each. Alternatively, instead of the operator performing estimation, a computer program may be configured to estimate the two repeat units A and B from information such as peak intervals in the peak list and so forth at the processing unit 4, and determine the mass information of the estimated repeat units A and B.

Next, in step S13, the processing unit 4 performs Kendrick mass computation regarding each of the peaks in the peak list based on the exact mass information of the repeat units A and B having been input in step S12, and finds Kendrick mass defect $D_A$ for the repeat unit A and Kendrick mass defect $D_B$ for the repeat unit B.

That is to say, based on the exact mass information of the repeat unit A, the processing unit 4 finds the Kendrick mass value for each peak by performing the computation of "exact mass of each peak×44.00000/44.02621", finds the Nominal Kendrick mass value by finding the integer value closest to the Kendrick mass value that has been found, and finds the Kendrick mass defect $D_A$ regarding the repeat unit A for each peak by finding the difference between the Kendrick mass value and the Nominal Kendrick mass value. Further, based on the exact mass information of the repeat unit B, the processing unit 4 finds the Kendrick mass value for each peak by performing the computation of "exact mass of each peak×58.00000/58.04132", finds the Nominal Kendrick mass value by finding the integer value closest to the Kendrick mass value that has been found, and finds the Kendrick mass defect $D_B$ regarding the repeat unit B for each peak by finding the difference between the Kendrick mass value and the Nominal Kendrick mass value. The values of Kendrick mass defect $D_A$ and $D_B$ obtained for each peak in this way are saved by being added to data regarding the exact mass information and ion intensity information for each peak in the peak list, as illustrated in FIG. 3C for example.

Next, in step S14, the processing unit 4 performs second Kendrick mass conversion processing, thereby finding Kendrick mass defect information $d_A$ of the repeat unit A based on the repeat unit B, and Kendrick mass defect information $d_B$ of the repeat unit B based on the repeat unit A.

That is to say, the processing unit 4 performs Kendrick mass conversion computation processing on the exact mass information of the repeat unit A based on the exact mass information of the repeat unit B, thereby acquiring Kendrick mass defect information $d_A$ of the repeat unit A relating to the repeat unit B. The processing unit 4 also performs Kendrick mass conversion computation processing on the exact mass information of the repeat unit B based on the exact mass information of the repeat unit A, thereby acquiring Kendrick mass defect information $d_B$ of the repeat unit B relating to the repeat unit A.

In the case of the Kendrick mass defect information $d_A$, the processing unit 4 computes "exact mass of repeat unit A (44.02621)×58.00000/58.04132−44", thereby obtaining $d_A$=−0.00513255.

On the other hand, in the case of the Kendrick mass defect information $d_B$, the processing unit 4 computes "exact mass of repeat unit B (58.04132)×44.00000/44.02621−58", thereby obtaining $d_B$=0.006766424.

Next, in step S15, the processing unit 4 uses the $d_A$ and $d_B$ obtained in step S14 to compute $n_A=D_B/d_A$ and $n_B=D_A/d_B$ regarding the Kendrick mass defect information $D_A$ and $D_B$ for each peak listed in the peak list that has been found in step S14, thereby finding degree-of-polymerization information $n_A$ of the repeat unit A and degree-of-polymerization information $n_B$ of the repeat unit B at each peak. The reason why computation of $D_B/d_A$ and $D_A/d_B$ yields degree-of-polymerization information will be described below.

Now, assuming that an ion having a certain peak in a mass spectrum is made up of $n_1$ repeat units A and $n_2$ repeat units B and is expressed as $(A)n_1(B)n_2$, the exact mass m1 of this ion can be expressed as follows.

$$m1=(44.02621)\times n_1+(58.04132)\times n_2 \quad (1)$$

This exact mass m1 is subjected to first Kendrick mass conversion processing described earlier, to find Kendrick mass defect information $D_A$ and $D_B$, which can be expressed as follows $$D_A=(44/44.02621)\times((44.02621)\times n_1+(58.04132)\times n_2)-N(m1) \quad (2A)$$

$$D_B=(58/58.04132)\times((44.02621)\times n_1+(58.04132)\times n_2)-N(m1) \quad (2B)$$

where N(m1) represents the nominal mass of the exact mass m1.

$D_A$ can be organized as follows.

$$D_A=44\times n_1+(44/44.02621)\times 58.04132\times n_2-N(m1)$$

While $D_A$ is a decimal number, the "$44\times n_1$" and N(m1) in the above expression are both integers, so $D_A$ is the decimal number portion of the term "$(44/44.02621)\times 58.04132\times n_2$" that has been extracted. Taking into consideration the fact that the value of "(44/44.02621)" is extremely close to 1, extracting the decimal number portion of the term "$(44/44.02621)\times 58.04132\times n_2$" is equivalent to subtracting "$58\times n_2$" from "$(44/44.02621)\times 58.04132\times n_2$".

In light of this, $D_A$ can be rewritten as follows.

$$D_A=(44/44.02621)\times 58.04132\times n_2-58\times n_2 \quad (3A)$$

In exactly the same way, $D_B$ can be rewritten as follows.

$$D_B=(58/58.04132)\times 44.02621\times n_1-44\times n_1 \quad (3B)$$

On the other hand, as described above, $d_A$ and $d_B$ are written as $$d_A=(44.02621)\times 58.00000/58.04132-44$$

$$d_B=(58.04132)\times 44.00000/44.02621-58$$

so the results of computing $n_B=D_A/d_B$ are as follows.

$$n_B=D_A/d_B=(44/44.02621\times 58.04132\times n_2-58\times n_2)/(58.04132\times 44/44.02621-58)=n_2 \quad (4B)$$

Accordingly, $n_B$ has information of the repeat count $n_2$ of the repeat unit B.

In exactly the same way, the results of computing $n_A=D_B$ $d_A$ are as follows.

$$n_A=D_B/d_A=((58/58.04132)\times 44.02621\times n_1-44\times n_1)/(44.02621)\times 58/58.04132-44)=n_1 \quad (4A)$$

Accordingly, $n_A$ has information of the repeat count $n_1$ of the repeat unit A.

The exact mass m1 of the ion has been assumed to be $(44.02621)\times n_1+(58.04132)\times n_2$ in the above description. However, the mass of terminal structures also adds thereto in reality, so numerical values based on the part of the terminal structures are also added on to $D_A$ and $D_B$, and when obtaining $n_B$ and $n_A$, the numerical values that have been added on are also divided by $d_B$ and $d_A$. Accordingly, the results of the division are not just purely integer information of $n_2$ and $n_1$, but "offset" based on the part of the terminal structures (there may be cases greater than 1) is also added thereto.

However, the degree-of-polymerization information $n_B$ and $n_A$ obtained for each peak have the same value for the "offset" in a case where the terminal structures are the same, and only the values of the repeat counts $n_2$ and $n_1$ differ. Accordingly, the difference (intervals) between the degree-of-polymerization information $n_B$ and $n_A$ for each peak are integers corresponding to the differences in $n_1$ and $n_2$ of each peak.

Peaks that do not have both repeat units A and B will have irregular intervals for $n_B$ and $n_A$ among the peaks, and do not yield integers.

From the above observation, $n_A$ and $n_B$ for each peak obtained by the computation of $D_B/d_A$ and $D_A/d_B$ clearly includes degree-of-polymerization information $n_A$ of the repeat unit A and degree-of-polymerization information $n_B$ of the repeat unit B for each of the peaks. The values of $n_A$ and $n_B$ for each peak found by computation at the processing unit 4 are written to the spaces for $n_A$ and $n_B$ for each peak in the peak list illustrated in FIG. 3C.

Next, in step S16, the processing unit 4 plots the peaks on two-dimensional coordinates where $n_A$ is allocated to the X axis and $n_B$ is allocated to the Y axis, based on the values of $n_A$ and $n_B$ of the peaks written to the peak list, and displays the plotted peaks on the screen of the display unit 6 such as illustrated in FIG. 3D, for example. Note that the sizes of the plots correspond to the intensity of the peaks.

In a case where a peak group having both repeat units A and B and peak group not having both coexist, the intervals of the plots of the peak group having both repeat units A and B are laid out at equidistant intervals of 1 as described above, but the intervals of the plots of the group not having both are not 1, and thus can be identified.

Even with a peak group having both repeat units A and B, in a case whether there are two groups having different terminal structures, the plots of the peak groups belonging to each of the groups are laid out at equidistant intervals of 1, but the plots of each group are shifted vertically/horizontally due to the difference in terminal structures.

Figure 4:
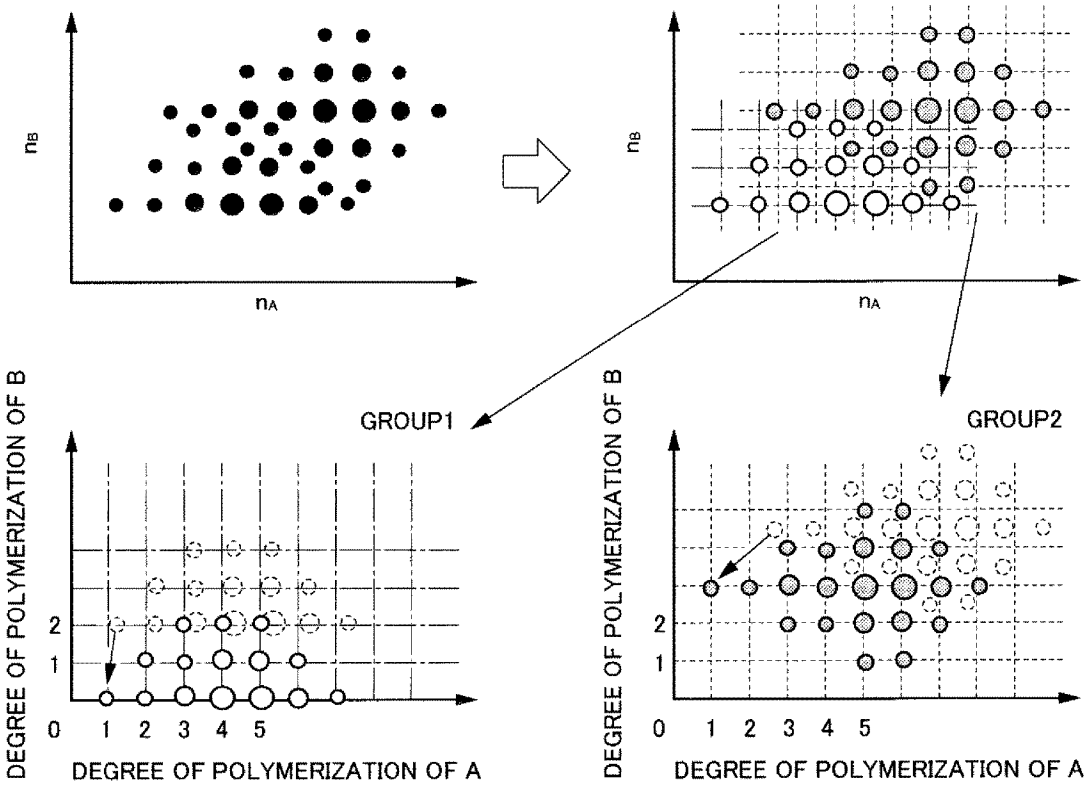
FIG. 4 is a diagram for describing the flow of procedures from step S17 through step S21 in FIG. 2.

Next, determination is made in step S17 regarding whether or not there are point groups laid out at equidistant intervals of 1 in both the X axis and Y axis directions, in the plots created in step S16. For example, it can be seen from the plots shown to the upper left in FIG. 4 that there are two types of point groups at equidistant intervals of 1, as shown to the upper right in FIG. 4.

In a case where there are point groups at equidistant intervals of 1, the flow advances to step S18.

In a case where there are no point groups at equidistant intervals of 1, the flow advances to step S22.

This step S17 can be performed either by a user viewing the created plots displayed on the display unit 6 or the like and determining, or by configuring a computer program for the processing unit 4 to determine from the created plots.

In step S18, point groups at equidistant intervals of 1 are extracted, and the flow advances to step S19. For example, in a case where there are two point groups at equidistant intervals of 1 as illustrated to the upper right in FIG. 4, each of the point groups is extracted, and held as Group 1 at the lower left in FIG. 4 and Group 2 at the lower right of FIG. 4.

This step S18 can be performed either by a user extracting point groups from the created plots displayed on the display unit 6 or the like, or by configuring a computer program for the processing unit 4 to extract point groups from the created plots.

In step S19, determination is made whether the terminal structure of the point group extracted in step S18 has been distinguished.

In a case where the terminal structure of the point group extracted in step S18 has been distinguished, the flow advances to step S20.

In a case where the terminal structure of the point group extracted in step S18 has not been distinguished, the flow advances to step S21.

In this step S19, the user can input from the operating unit 5 whether the terminal structure has been determined, for example, and in a case where the terminal structure has been determined, input the name of the determined terminal structure.

In steps S20-S21, the repeat counts (above-described $n_1$ and $n_2$) of the repeat units A and B are determined based on the distinguished terminal structure, the point groups extracted in step S18 are shifted based on the determined $n_1$ and $n_2$ , and plotted on two-dimensional coordinates where $n_A$ is allocated to the X axis and $n_B$ is allocated to the Y axis.

Determination of $n_1$ and $n_2$ is performed as follows, for example. Description has been made as follows in the description relating to the above-described Expressions (4A) and (4B).

"The exact mass m1 of the ion has been assumed to be $(44.02621)\times n_1+(58.04132)\times n_2$. However, the mass of terminal structures also adds thereto, so numerical values based on the part of the terminal structures are also added on to $D_A$ and $D_B$, and when obtaining $n_B$ and $n_A$, the numerical values that have been added on are also divided by $d_B$ and $d_A$. Accordingly, the results of the division are not just purely integer information of $n_2$ and $n_1$, but 'offset' based on the part of the terminal structures (there may be cases greater than 1) is also added thereto."

In order to consider this "offset", the structure of an ion having a certain peak in a mass spectrum is represented as $(A)n_1(B)n_2(X)$ including the terminal structure X, and the exact mass m1 of this ion is expressed including mass $m_x$ of the terminal structure X, as follows.

$$m_1=(44.02621)\times n_1+(58.04132)\times n_2+m_x \tag{11}$$

Finding $D_A$ and $D_B$ in the same way as with Expressions (2A) and (2B) assuming this Expression (11), and further finding $n_B=D_A/d_B$ and $n_A=D_B/d_A$ yields the following, details of which are omitted here.

$$n_B=n_2+(d_{xA}/d_B) \tag{14B}$$

$$n_A=n_1+(d_{xB}/d_A) \tag{14A}$$

The terms $(d_{xA}/d_B)$ and $(d_{xB}/d_A)$ in the above expressions are equivalent to the portion described earlier as being "offsets" based on the portion of terminal structures.

Now, "$d_{xA}$" is Kendrick mass defect information obtained by subjecting the exact mass $m_x$ of the terminal structure X to Kendrick mass conversion processing based on the repeat unit A, and "$d_{xB}$" is Kendrick mass defect information obtained by subjecting the exact mass $m_x$ of the terminal structure X to Kendrick mass conversion processing based on the repeat unit B.

In a case where the exact mass $m_x$ of the terminal structure X is known, "$d_{xA}$" and "$d_{xB}$" can be calculated by the following calculations.

$$d_{xA}=(58/58.04132)\times m_x-N(m_x)$$

$$d_{xB}=(44/44.02621)\times m_x-N(m_x)$$

Since the values of $d_A$ and $d_B$ are both known, having been calculated in step S15 and stored in the peak list, the values of $n_2$ and $n_1$ are found by the following Expressions.

$$n_2=n_B(d_{xA}/d_B) \tag{15B}$$

$$n_1=n_A(d_{xB}/d_A) \tag{15A}$$

Calculation of the repeat counts $n_1$ and $n_2$ of the repeat units A and B based on these Expressions (15A) and (15B) is performed regarding all of the extracted peaks, for example. The peaks are plotted on two-dimensional coordinates where $n_A$ is allocated to the X axis and $n_B$ is allocated to the Y axis, based on the values of $n_A$ and $n_B$ found for each of the peaks, and displayed. For example, the plots of the peaks will be displayed as solid line circles at the lower left in FIG. 4 (Group 1) and the lower right in FIG. 4 (Group 2). Comparing these with the state of only having been extracted, indicated by dotted lines (the plot positions are determined by ($n_A$ and $n_B$)), the entirely has been shifted, and since $n_1$ and $n_2$ are integers, each plot is situated at a grid point measured out in increments of integers.

In this way, the peaks are plotted at positions corresponding to the repeat counts $n_1$ and $n_2$ of the repeat units A and B for each group with different terminal structures, so the distribution of the degree of polymerization of the repeat units A and B can be visually and clearly comprehended.

Although description has been made in the above example that calculation of $n_1$ and $n_2$ is performed for all of the extracted peaks, this does not necessarily have to be performed. For example, if calculation of $n_1$ and $n_2$ is performed based on Expressions (15A) and (15B) regarding one particular peak, and that peak is plotted at a position determined by the $n_1$ and $n_2$ that have been found, the plot is shifted in the X and Y directions from the state of only having been extracted, indicated by dotted lines (the plot positions are ($n_A$ and $n_B$)), and the amount of shifting can be found from $-(d_{xB}/d_A)$ for the X direction and $-(d_{xA}/d_B)$ for the Y direction, from Expressions (15A) and (15B). This amount of shift is common to all peaks in the same group that has been extracted, so the remaining peaks can be all plotted and displayed at the same positions as calculating and plotting all peaks, by shifting from the state of only having been extracted, indicated by dotted lines ($n_A$ and $n_B$), by the above-described common shift amount, and plotting and displaying.

Determination is made in step S22 regarding whether or not there are equidistant point groups remaining in the plots that have not yet been extracted. Points that are not equidistant are disregarded as noise.

In a case where there are equidistant point groups remaining, the flow returns to step S17, and determination is made regarding whether or not the intervals of the remaining equidistant point group are 1 on both the X axis and Y axis directions. If the intervals of the point group are 1, this is handled as a point group having a different terminal structure from the point group already extracted, and the remaining point group with intervals of 1 is extracted in step S18.

In a case where there are no equidistant point groups remaining, the analysis ends.

This step S22 can be performed either by a user viewing the plots and determining, or by configuring a computer program for the processing unit 4 to determine from the created plots.

In step S23, determination is made regarding whether or not there is an equidistant point group of which the intervals are other than 1.

In a case where there is an equidistant point group of which the intervals are other than 1, the repeat unit decided at the beginning is not correct, so the flow returns to step S13, and the repeat unit is decided again.

Figure 5:
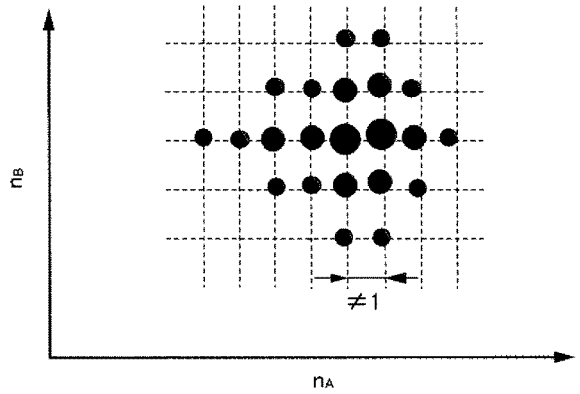
FIG. 5 is a diagram illustrating a case where intervals between points are intervals other than 1, in step S22 in FIG. 2.
Figure 6A:
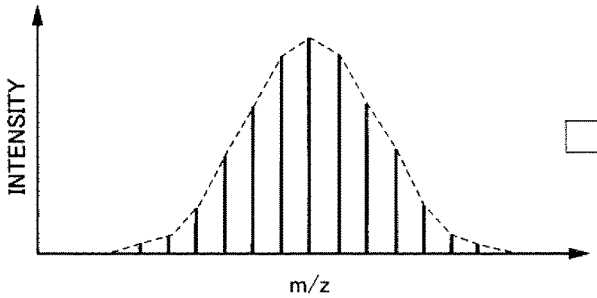
FIG. 6A is a mass spectrum of a polymer having one type of repeat unit.
Figure 6B:
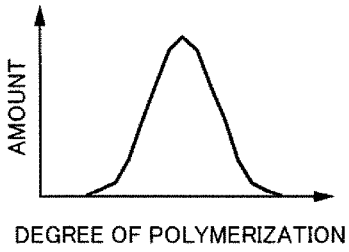
FIG. 6B is a distribution of the degree of polymerization of the polymer having one type of repeat unit.
Figure 7A:
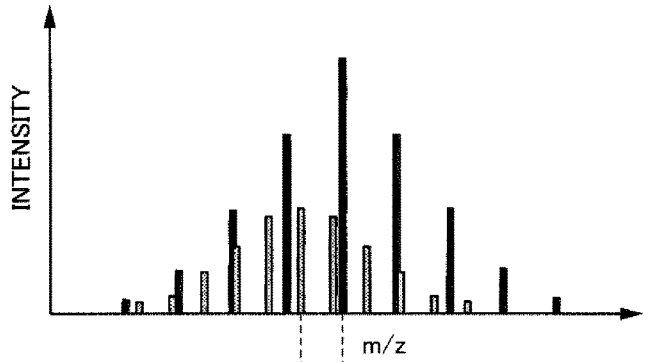
FIGS. 7A and 7B are diagrams for describing a method of creating a Kendrick mass plot from a mass spectrum.
Figure 7B:
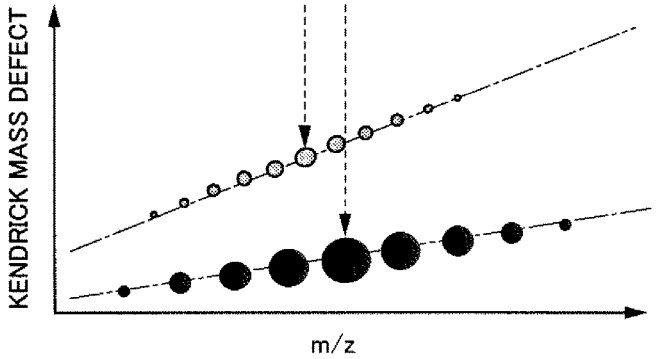
Figure 8:
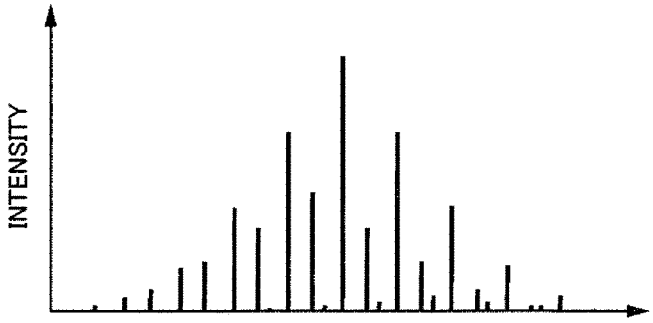
FIG. 8 is a mass spectrum including peaks that have shifted due to terminal structures.
Figure 9:
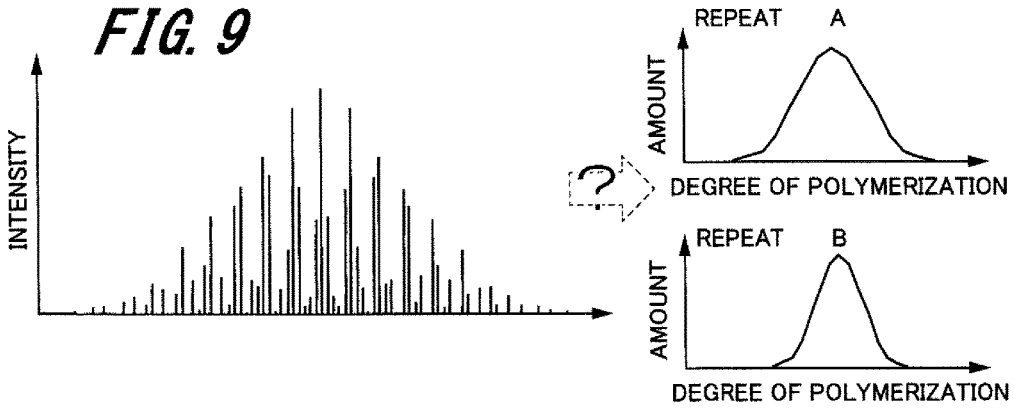
FIG. 9 is a diagram for describing a mass spectrum of a copolymer having two or more types of repeat units.
Figure 10A:
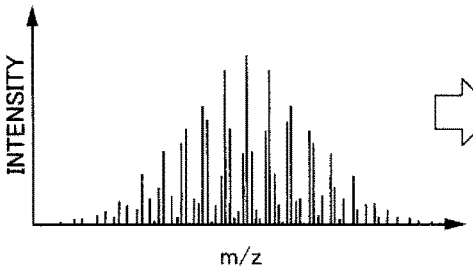
FIGS. 10A and 10B are diagrams describing an example of a case of applying the analysis method using the Kendrick mass plot to the mass spectrum of a copolymer having two or more types of repeat units.
Figure 10B:
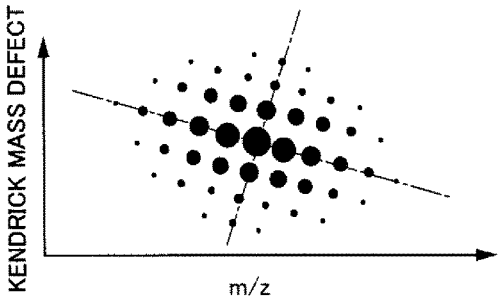
Figure 11:
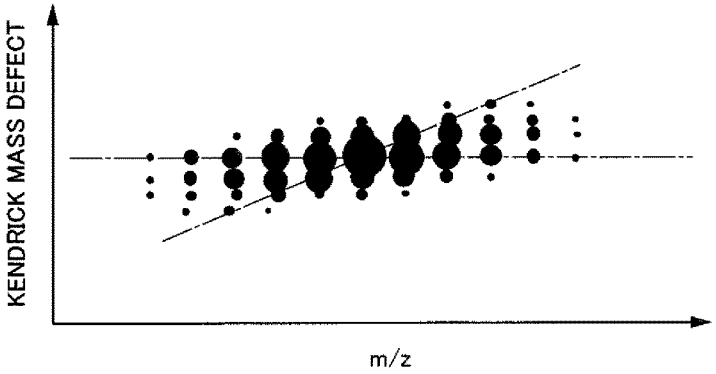

For example, there is a point group of which the intervals of $n_A$ are not 1 in the plots illustrated in FIG. 5, so the repeat unit A needs to be decided again to a different structure.

On the other hand, in a case where there are no equidistant point groups, there are not repeat units in the measured specimen, so the flow returns to step S11, and proceeds to measurement of the next specimen.

This step S23 can be performed either by a user viewing the plots and determining, or by configuring a computer program for the processing unit 4 to determine from the created plots.

Configurations may be made where a part of the components of the mass spectroscope 10 described above have been omitted, and configurations may be made including components which service as multiple components.

Figure 12B:
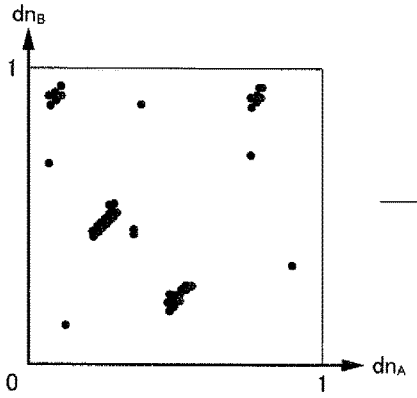
FIGS. 12A through 12D are diagrams describing a modification of the mass spectrometry data analysis method.

An arrangement has been described in the above embodiment where peaks are plotted on two-dimensional coordinates where $n_A$ and $n_B$ are the horizontal and vertical axes based on the values of $n_A$ and $n_B$ of the peaks found by calculation (see FIG. 3D), this is not restrictive. An arrangement may be made where the decimal number part $dn_A$ and $dn_B$ of $n_A$ and $n_B$ are extracted for each peak, and peaks are plotted on two-dimensional coordinates where $dn_A$ and $dn_B$ are the horizontal and vertical axes based on the values of $dn_A$ and $dn_B$ that have been extracted. FIG. 12B illustrates an example of such plots. FIG. 12A illustrates the mass spectrum serving as the base.

Performing plotting such as illustrated in FIG. 12B results in peaks having the repeat units A and B and having the same terminal structures to be plotted together at the same position, and peaks having a different terminal structure to be plotted grouped at a different position, so peaks can be grouped based on terminal groups.

That is to say, the degree-of-polymerization information $n_A$ and $n_B$ each have information of "offset" based on terminal structures, in addition to information of the repeat counts $n_1$ and $n_2$ of the repeat units A and B. There are cases where this "offset" is smaller than 1 or greater than 1. Accordingly, extracting the decimal number parts $dn_A$ and $dn_B$ from the degree-of-polymerization information $n_A$ and $n_B$ means erasing the degree-of-polymerization information of $n_1$ and $n_2$, and extracting only the "offset" information. The values of the decimal number parts $dn_A$ and $dn_B$ of the "offset" information differ according to the type of terminal structure, so plotting peaks on two-dimensional coordinates where $dn_A$ and $dn_B$ are the horizontal and vertical axes as in FIG. 12B results in peaks having the same terminal structures to be plotted together at the same position, and peaks having a different terminal structure to be plotted grouped at a different position.

Figure 12C:
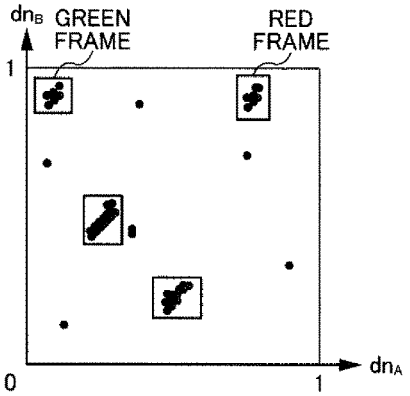
Figure 12A:
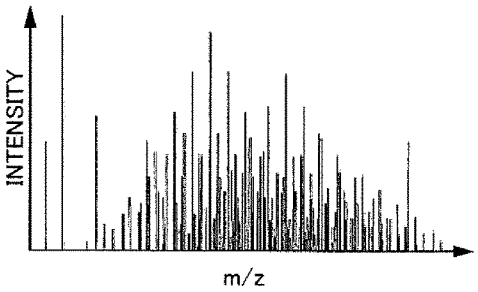
Figure 12D:
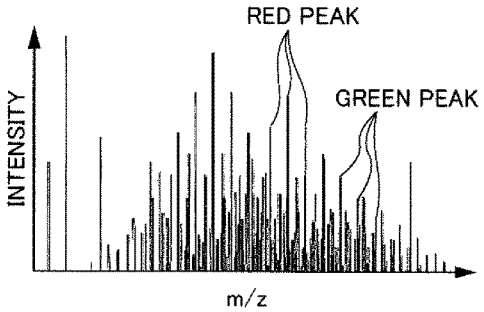

An arrangement where peaks of a particular group plotted together at one position in this way are specified by frame specification or the like for example, as illustrated in FIG. 12C, and a mass spectrum is displayed where the peaks belonging to this specified group differ in display format (e.g., color) from other peaks, such as illustrated in FIG. 12D, enables easily identifying which of the peaks appearing in the mass spectrum have the repeat units A and B, and also have a particular terminal structure.

Figure 13:
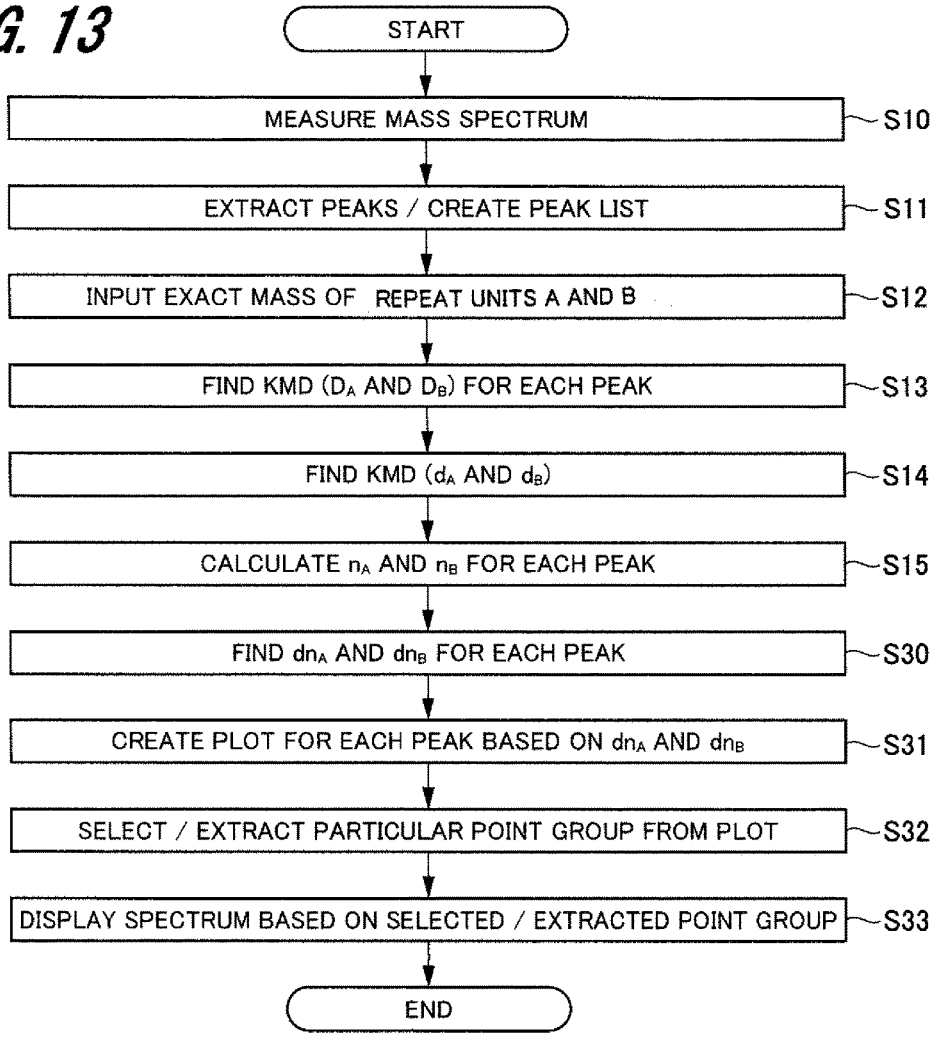
FIG. 13 is a flowchart illustrating a modification of the mass spectrometry data analysis method.

FIG. 13 is a flowchart illustrating the flow of processing performed when plotting peaks on two-dimensional coordinates where the above-described $dn_A$ and $dn_B$ are the horizontal and vertical axes. Steps S10 through S15 are the same as in the flowchart in FIG. 2. Thereafter, other steps have been added where, in step S30, $dn_A$ and $dn_B$ are obtained regarding each of the peaks (step S30), the peaks are plotted on two-dimensional coordinates where the $dn_A$ and $dn_B$ that have been found are the horizontal and vertical axes (step S31), a particular point group is selected/extracted from the plots (step S32), and a spectrum display is made distinguishing the peaks belonging to the point group based on the selected/extracted point group from other peaks (step S33).

What is claimed is:

1. A method for analyzing a specimen having a composition where two different reference chemical structures A and B are each repeated, the method comprising:

acquiring mass spectrum data by performing mass spectrometry of the specimen using a mass spectroscope;

acquiring exact mass information of each peak appearing on the mass spectrum;

performing Kendrick mass conversion computation processing on the exact mass information of each peak based on exact mass theoretical value information and nominal mass information for each of the reference chemical structures A and B, to obtain Kendrick mass information for each peak;

extracting a decimal number part of the Kendrick mass information to obtain each of Kendrick mass defect information DA and DB for each peak;

performing Kendrick mass conversion computation processing on exact mass theoretical value information of the reference chemical structure B based on exact mass theoretical value information and nominal mass information of the reference chemical structure A to acquire Kendrick mass information;

extracting a decimal number portion of the obtained Kendrick mass information to acquire Kendrick mass defect information $d_A$;

performing Kendrick mass conversion computation processing on exact mass theoretical value information of the reference chemical structure A based on exact mass theoretical value information and nominal mass information of the reference chemical structure B to acquire Kendrick mass information;

extracting a decimal number portion of the obtained Kendrick mass information to acquire Kendrick mass defect information $d_B$;

performing computation of:

$$n_A=D_B/d_A,\ n_B=D_A/d_B$$

on the Kendrick mass defect information $D_A$ and $D_B$ of each peak, using the Kendrick mass defect information $d_A$ and $d_B$, thereby obtaining degree-of-polymerization information $n_A$ and $n_B$ for each peak; and displaying plots corresponding to each peak on two-dimensional coordinates where the $n_A$ is a first axis and the $n_B$ is a second axis, based on the degree-of-polymerization information $n_A$ and $n_B$ for each peak, wherein the plots corresponding to each peak are displayed equidistantly and in sizes corresponding to intensity of each peak;

extracting, from the plots, a point group having equidistant intervals of 1 regarding $n_A$ and $n_B$ based on a terminal structure of the specimen being known;

determining repeat counts $n_1$ and $n_2$ for each of repeat units A and B regarding part or all peaks pertaining to the extracted point group based on exact mass information of the terminal structure;

shifting the extracted point group based on the decided repeat counts $n_1$ and $n_2$; and plotting plots corresponding to each peak of the extracted point group on intersections of coordinate axes each in increments of an integer of a two-dimensional coordinate system where the $n_A$ is allocated to a first axis and the $n_B$ to a second axis, wherein if the extracted point group includes two or more groups, plotting each group on separate two-dimensional coordinate systems.

* * * * *